US012789106B1

(12) United States Patent
Stodart

(10) Patent No.: US 12,789,106 B1
(45) Date of Patent: Nov. 10, 2026

(54) BALLOON INFLATER

(71) Applicant: Buffalo Blanks LLC, Wynnewood, OK (US)

(72) Inventor: Craig R. Stodart, Wynnewood, OK (US)

(73) Assignee: Wildhorse Balloon Systems LLC, Wynnewood, OK (US)

( * ) Notice: Subject to any disclaimer, the term of this patent is extended or adjusted under 35 U.S.C. 154(b) by 0 days.

(21) Appl. No.: 19/199,243

(22) Filed: May 5, 2025

Related U.S. Application Data

(60) Provisional application No. 63/642,737, filed on May 4, 2024.

(51) Int. Cl.
*A63H 27/10* (2006.01)

(52) U.S. Cl.
CPC ..... *A63H 27/10* (2013.01); *A63H 2027/1033* (2013.01); *A63H 2027/1041* (2013.01); *A63H 2027/1083* (2013.01)

(58) Field of Classification Search
CPC ..... A63H 27/10; A63H 2027/1033; A63H 2027/1041; A63H 2027/1083
USPC ..... 141/1
See application file for complete search history.

(56) References Cited

U.S. PATENT DOCUMENTS

| | | | | |
|---|---|---|---|---|
| 3,380,490 | A * | 4/1968 | Ellenberg | G07F 11/58 141/181 |
| 3,616,823 | A * | 11/1971 | Dello | G07F 13/02 141/181 |
| 5,370,161 | A * | 12/1994 | Shafer | A63H 27/10 141/369 |
| 2005/0076968 | A1* | 4/2005 | Ratermann | A63H 27/10 141/114 |
| 2009/0223568 | A1* | 9/2009 | Crandell | A63H 27/10 141/168 |

* cited by examiner

*Primary Examiner* — Christopher M Afful
(74) *Attorney, Agent, or Firm* — Brent Whitlock Law, LLC; Brent K. Whitlock

(57) ABSTRACT

A balloon inflater system includes a rotatable curved inflater wheel having alignment pins that radially extend outward and air passages for passing airflow from a compressed air source through air passage outlets and into balloons positioned thereat. A balloon-positioning belt includes alignment holes that mate with the alignment pins to be driven by the inflater wheel and balloon centering holes that hold balloons for positioning over respective air passage outlets, for inflating the balloons with the airflow from the inflater wheel. An inflater wheel drive system causes the inflater wheel to rotate a predetermined angle of rotation to place a next balloon disposed on the balloon-positioning belt in an inflation position. An airflow control timer causes airflow from the compressed air source to inflate the balloon disposed on the balloon-positioning belt in the inflation position.

20 Claims, 8 Drawing Sheets

BALLOON INFLATER

CROSS-REFERENCE TO RELATED APPLICATION

This application claims the priority benefit of U.S. provisional patent application Ser. No. 63/642,737 entitled "BALLOON INFLATER" and filed on May 4, 2024, the disclosure of which is incorporated herein in full.

BACKGROUND

The sport of cowboy mounted shooting involves shooting balloons as targets. Competitive shooters may be mounted on and riding horses while shooting at their targets. Competitors rely on balloons to be properly inflated with compressed air, sealed to avoid losing air during the competition, and positioned properly for use as targets. Consistency between size and air pressure of inflated balloons is also a factor affecting competitions.

The description provided in the background section should not be assumed to be prior art merely because it is mentioned in or associated with the background section. The background section may include information that describes one or more aspects of the subject technology.

SUMMARY

An exemplary balloon inflater system includes a rotatable curved inflater wheel having alignment pins that radially extend from an outer curved edge of the inflater wheel to rotate synchronously with the inflater wheel, and air passages for passing airflow from a compressed air source through air passage outlets and into balloons positioned at respective ones of the air passage outlets. The system also includes a balloon-positioning belt having alignment holes that mate with the alignment pins to be driven by the inflater wheel, and balloon centering holes that hold balloons for positioning the balloons over the respective air passage outlets, based on relative positioning of the balloon centering holes and the alignment holes, for inflating the balloons with the airflow from the inflater wheel. The system further includes an inflater wheel drive system that causes the inflater wheel to rotate a predetermined angle of rotation to place a next balloon disposed on the balloon-positioning belt in an inflation position, and an airflow control timer that causes airflow from the compressed air source to inflate the balloon disposed on the balloon-positioning belt in the inflation position for a preset period of time.

The inflater wheel may include balloon inflater inserts that are positioned at the air passage outlets and configured to pass through the balloon-positioning belt's balloon centering hole and be inserted into the balloon positioned at the balloon centering hole for inflating the balloon.

The inflater wheel drive system may include an inflater wheel motor and translate motive power from the inflater wheel motor to rotate the inflater wheel the predetermined angle of rotation to place the next balloon disposed on the balloon-positioning belt in the inflation position. The inflater wheel drive system may include a drive wheel that is driven by the inflater wheel motor to rotate about an axis perpendicular to the plane of the inflater wheel and offset from a center axis of the inflater wheel. The inflater wheel drive system may also include a ratchet arm having a first end configured to rotate about the center axis of the inflater wheel. The inflater wheel drive system may also include a linkage arm having a first end configured to be moved about a circle by the drive wheel and a second end rotatably coupled with a second end of the ratchet arm. The inflater wheel drive system may also include a ratchet pawl rotatably coupled with the second end of the ratchet arm and the second end of the linkage arm, the ratchet pawl weighted at a distal end to cause a proximal end of the ratchet pawl engage with ratchet teeth evenly disposed about a circular path on a side of the inflater wheel to which the ratchet arm is disposed. A single rotation of the drive wheel may cause the inflater wheel to rotate an angle corresponding to the angular distance between neighboring ratchet teeth.

A single rotation of the drive wheel may cause the inflater wheel to rotate the predetermined angle of rotation to place the next balloon disposed on the balloon-positioning belt in the inflation position.

The system may include a plurality of idler pulleys configured to guide the balloon-positioning belt along a circular path driven by the inflater wheel, while the balloon-positioning belt holds balloons disposed within the balloon-centering holes. The balloon-positioning belt may be constructed as a closed loop.

The inflater wheel may include a plurality of air passage inlets corresponding to the plurality of air passage outlets, each air passage inlet operably coupled with a respective air passage outlet through a respective air passage through an interior of the inflater wheel. The air passage inlets may be disposed on a side of the inflater wheel opposite the inflater wheel drive system and evenly disposed about a circular path proximate the outer curved edge of the inflater wheel. The inflater wheel may also include an air valve coupled with a valve stem that receives airflow from the compressed air source, and a pressure plate that presses the air valve against a side of the inflater wheel to seal the air valve around a corresponding air passage inlet when inflating a respective balloon positioned over the respective air passage outlet, and releases pressure of the air valve against the side of the inflater wheel when the inflater wheel rotates to place the next balloon disposed on the balloon-positioning belt in the inflation position.

The pressure plate may be pivotally fixed to a frame to which the inflater wheel is rotatably attached on one end, and may be alternately pressed toward the inflater wheel and released away from the inflater wheel by a pressure applicator position adjuster on an opposite end of the pressure plate.

The system may include a timing wheel and a timing wheel motor configured to rotate the timing wheel responsive to a signal to place the next balloon disposed on the balloon-positioning belt in the inflation position. The system may also include a rocker arm configured to pivot about a rocker arm pivot point. The rocker arm may have the pressure applicator position adjuster on one end and a roller wheel on the other end, with the rocker arm pivot point disposed between the pressure applicator position adjuster and the roller wheel. The system may also include a protrusion disposed on a side of the timing wheel and configured to rest under the roller wheel when a balloon is disposed in the inflation position while pressing outward against the roller wheel to cause the rocker arm to pivot about the rocker arm pivot point to cause the pressure applicator position adjuster to press the pressure applicator and the air valve against the side of the inflator wheel with the respective air passage inlet.

The timing wheel may include a first wheel indentation bump on one side of the timing wheel and a second wheel indentation bump on an opposite side of the timing wheel. The second wheel indentation bump may be proximate and temporally behind the first wheel indentation bump relative to a rotational direction of the timing wheel. The system may further include a first control arm and switch operative to initiate inflation of the balloon disposed on the balloon-positioning belt in the inflation position when engaging with the first wheel indentation bump, and a second control arm and switch operative to cause the timing wheel motor to rotate the timing wheel when the second control arm is not engaging with the second wheel indentation bump until the second control arm again engages with the second wheel indentation bump after one rotation of the timing wheel.

The inflater wheel may be rotated by the inflater wheel drive system responsive to rotation of the timing wheel. The first control arm and switch may initiate inflation of the balloon disposed on the balloon-positioning belt in the inflation position by engaging with the first wheel indentation bump near the end of a rotation of the timing wheel.

An exemplary method of operating a balloon inflater system for inflating a series of balloons includes positioning a balloon-positioning belt to travel along a curved outside edge of a rotatable curved inflater wheel. The curved inflater wheel includes alignment pins that radially extend from an outer curved edge of the inflater wheel to rotate synchronously with the inflater wheel, and air passages for passing airflow from a compressed air source through air passage outlets and into balloons positioned at respective ones of the air passage outlets. The balloon-positioning belt includes alignment holes that mate with the alignment pins to be driven by the inflater wheel, and balloon centering holes that hold balloons for positioning the balloons over the respective air passage outlets, based on relative positioning of the balloon centering holes and the alignment holes, for inflating the balloons with the airflow from the inflater wheel. The method also includes placing a next balloon disposed on the balloon-positioning belt in an inflation position by causing the inflater wheel to rotate a predetermined angle of rotation by an inflater wheel drive system, and causing airflow from the compressed air source to inflate the balloon disposed on the balloon-positioning belt in the inflation position for a preset period of time by an airflow control timer.

The method may include positioning balloon inflater inserts at the air passage outlets of the inflater wheel to pass through the balloon-positioning belt's balloon centering hole and be inserted into the balloon positioned at the balloon centering hold for inflating the balloon.

The method may include rotating the inflater wheel the predetermined angle of rotation to place the next balloon disposed on the balloon-positioning belt in the inflation position by translating motive power from an inflater wheel motor comprised by the inflater wheel drive system, and driving a drive wheel by the inflater wheel motor to rotate about an axis perpendicular to the plane of the inflater wheel and offset from a center axis of the inflater wheel. The method may also include rotating a first end of a ratchet arm about the center axis of the inflater wheel, and moving a first end of a linkage arm coupled with the drive wheel about a circle of the drive wheel while a second end of the linkage arm is rotatably coupled with and moves a second end of the ratchet arm. The method may include causing a proximal end of a ratchet pawl to engage with ratchet teeth evenly disposed about a circular path on a side of the inflater wheel to which the ratchet arm is disposed, the ratchet pawl rotatably coupled with the second end of the ratchet arm and the second end of the linkage arm, the ratchet pawl weighted at a distal end. A single rotation of the drive wheel may cause the inflater wheel to rotate an angle corresponding to the angular distance between neighboring ratchet teeth.

The method may include rotating the inflater wheel the predetermined angle of rotation in a single rotation of the drive wheel to place the next balloon disposed on the balloon-positioning belt in the inflation position.

The method may include guiding, by a plurality of idler pulleys, the balloon-positioning belt along a circular path driven by the inflater wheel, while the balloon-positioning belt holds balloons disposed within the balloon-centering holes, wherein the balloon-positioning belt is constructed as a closed loop.

The method may include receiving airflow from the compressed air source at a valve stem coupled with an air valve. The method may also include pressing the air valve against a side of the inflater wheel, by a pressure plate, to seal the air valve around a corresponding air passage inlet that corresponds to a respective air passage outlet The air passage inlet may be operably coupled with the respective air passage outlet through a respective air passage through an interior of the inflater wheel, the air passage inlets disposed on a side of the inflater wheel opposite the inflater wheel drive system and evenly disposed about a circular path proximate the outer curved edge of the inflater wheel. The method may also include releasing pressure of the air valve against the side of the inflater wheel when the inflater wheel rotates to place the next balloon disposed on the balloon-positioning belt in the inflation position.

The method may also include alternately pressing the pressure plate toward the inflater wheel and releasing the pressure plate away from the inflater wheel by a pressure applicator position adjuster on one end of the pressure plate, while pivoting the pressure plate about a pivot point at which the pressure plate is fixed to a frame to which the inflater wheel is rotatably attached on an opposite end of the pressure plate.

The method may also include rotating a timing wheel by a timing wheel motor responsive to a signal to place the next balloon disposed on the balloon-positioning belt in the inflation position, and pivoting a rocker arm about a rocker arm pivot point. The rocker arm may have the pressure applicator position adjuster on one end and a roller wheel on the other end, the rocker arm pivot point disposed between the pressure applicator position adjuster and the roller wheel. The method may also include positioning a protrusion disposed on a side of the timing wheel under the roller wheel when a balloon is disposed in the inflation position while pressing outward against the roller wheel to cause the rocker arm to pivot about the rocker arm pivot point. The method may also include causing the pressure applicator position adjuster to press the pressure applicator and the air valve against the side of the inflater wheel with the respective air passage inlet, by the pivoting of the rocker arm about the rocker arm pivot point.

The timing wheel may include a first wheel indentation bump on one side of the timing wheel and a second wheel indentation bump on an opposite side of the timing wheel, the second wheel indentation bump proximate and temporally behind the first wheel indentation bump relative to a rotational direction of the timing wheel. The method may also include initiating inflation of the balloon disposed on the balloon-positioning belt in the inflation position, by a first control arm and switch when engaging with the first wheel indentation bump, and causing the timing wheel motor to rotate the timing wheel, by a second control arm and switch when the second arm is not engaging with the second wheel indentation bump until the second control arm again engages with the second wheel indentation bump after one rotation of the timing wheel.

The method may also include rotating the inflater wheel by the inflater wheel drive system responsive to rotation of the timing wheel, and initiating inflation of the balloon disposed on the balloon-positioning belt in the inflation position by the first control arm and switch engaging with the first wheel indentation bump near the end of a rotation of the timing wheel.

BRIEF DESCRIPTION OF DRAWINGS

The disclosure is better understood with reference to the following drawings and description. The elements in the figures are not necessarily to scale, emphasis instead being placed upon illustrating the principles of the disclosure. Moreover, in the figures, like-referenced numerals may designate to corresponding parts throughout the different views.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

Figure 1:
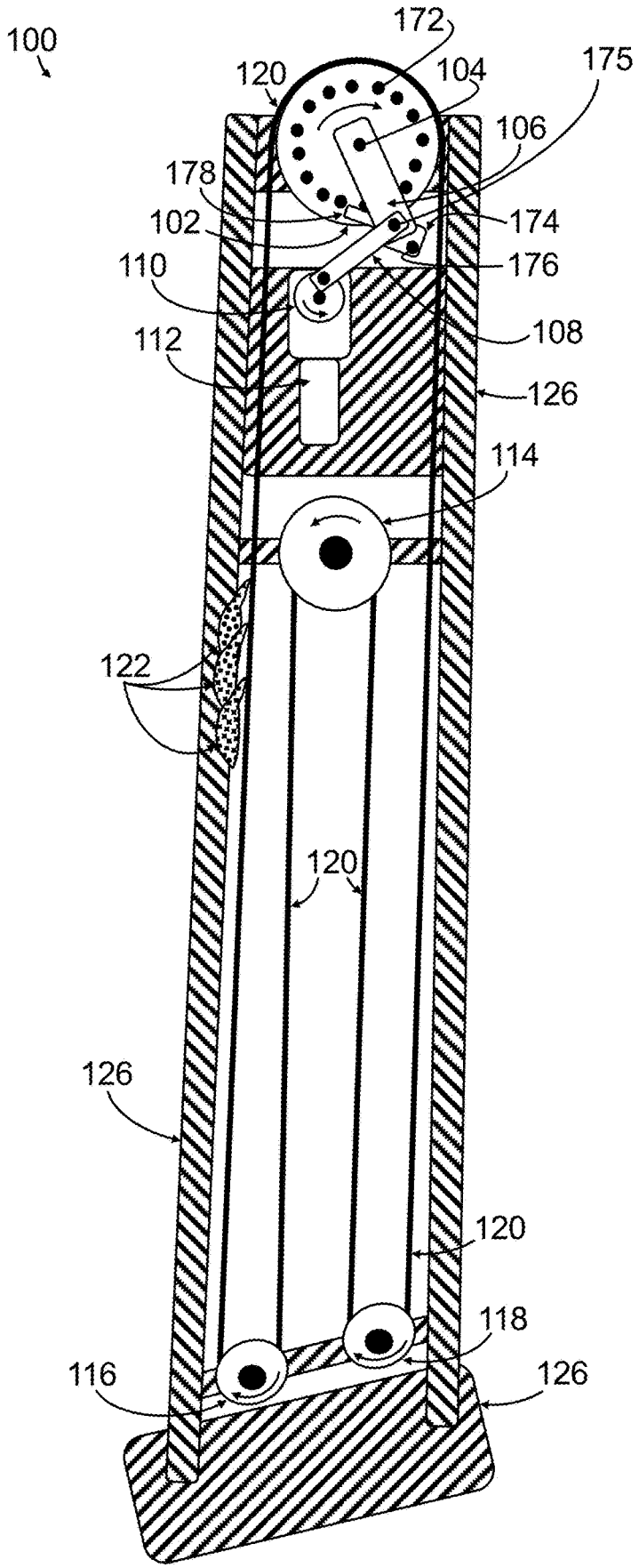
FIG. 1 is a diagram that illustrates a front view of an exemplary balloon inflater system.
Figure 2:
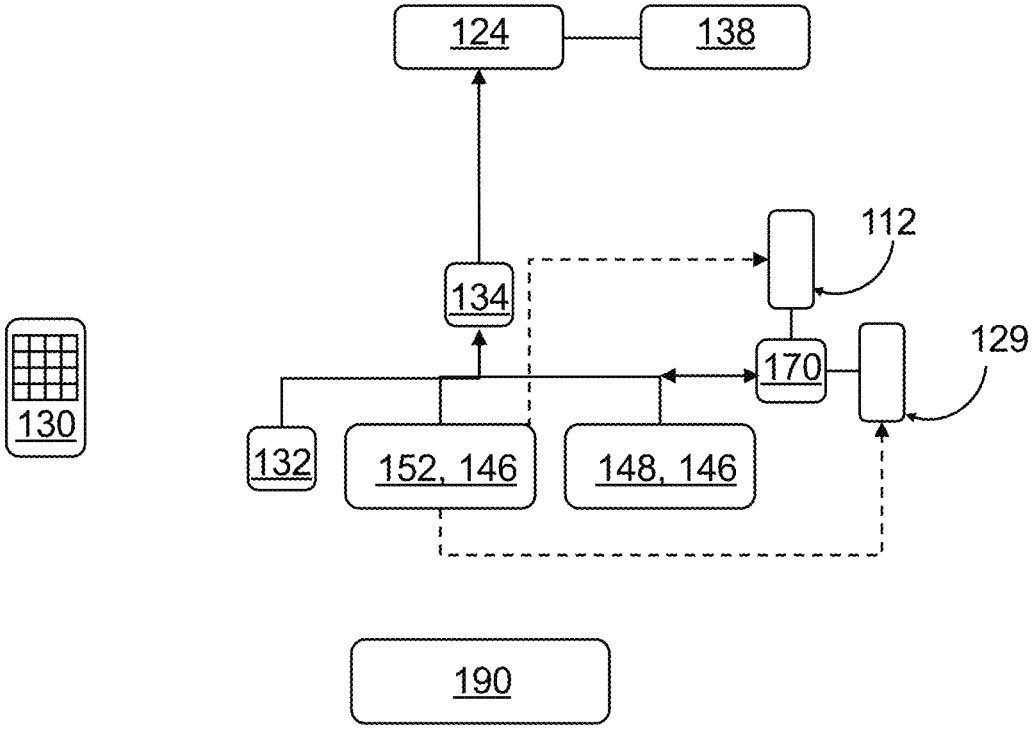
FIG. 2 is a diagram that illustrates exemplary electronic components of an electronic control system for the exemplary balloon inflater system.
Figure 3:
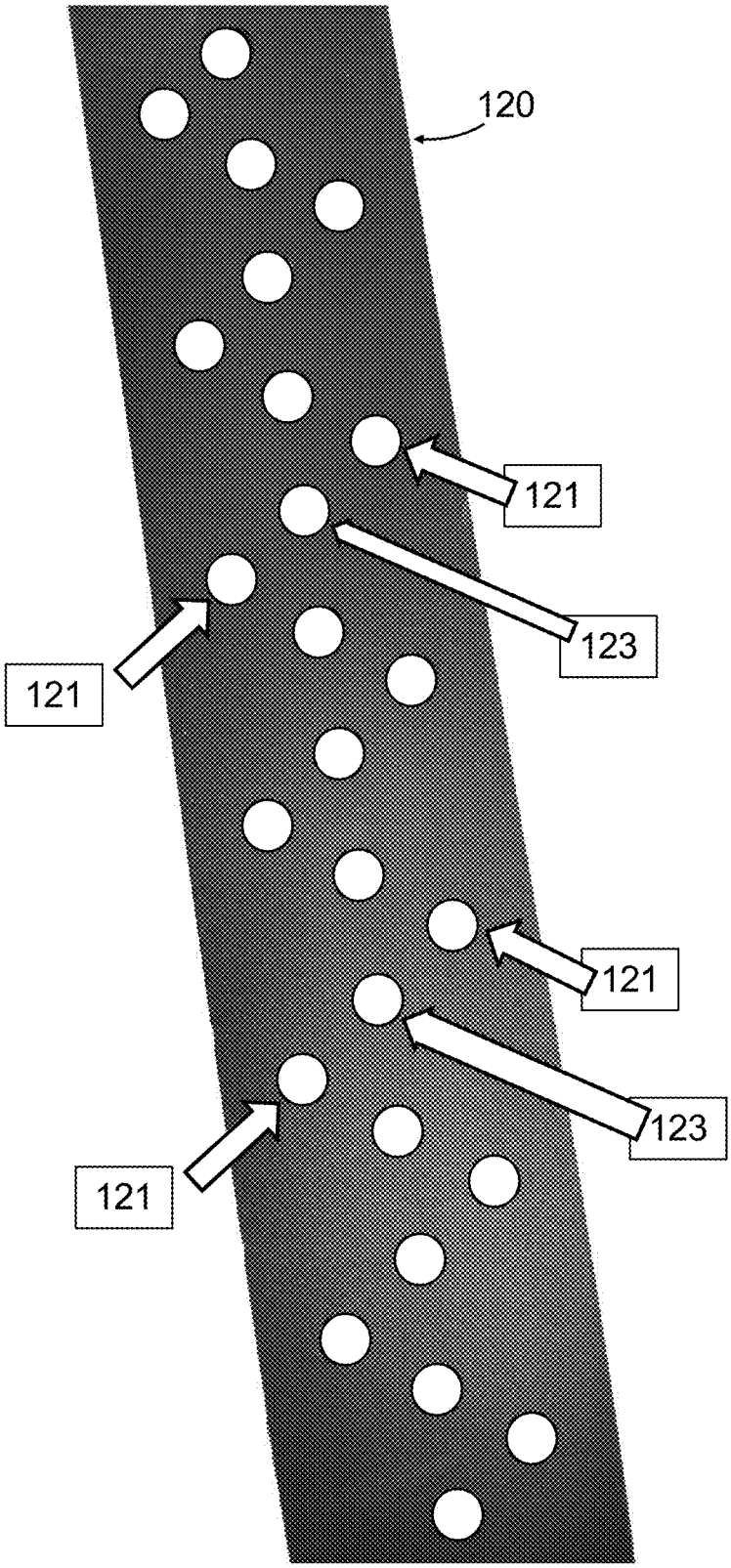
FIG. 3 is a diagram that illustrates a pattern of outside holes and center holes in an exemplary balloon-positioning belt for the balloon inflater system.
Figure 4:
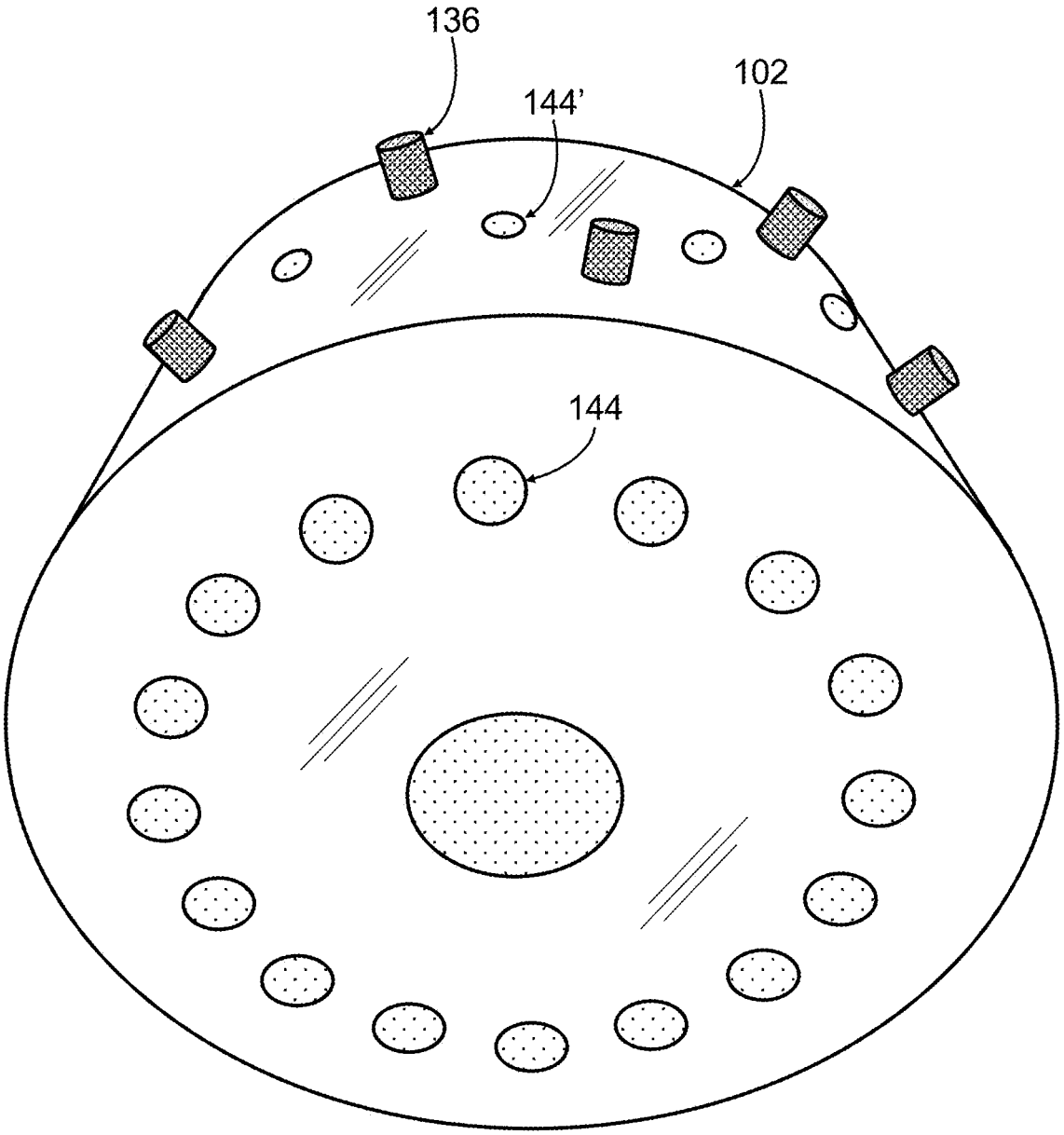
FIG. 4 is a diagram that illustrates a perspective view of an exemplary inflater wheel.

FIG. 1 is a diagram that illustrates a front view of an exemplary balloon inflater system 100. FIG. 2 is a diagram that illustrates exemplary electronic components of an electronic control system for the exemplary balloon inflater system 100. FIG. 3 is a diagram that illustrates a pattern of outside holes 121 and center holes 123 in an exemplary balloon-positioning belt 120 for the balloon inflater system 100. FIG. 4 is a diagram that illustrates a perspective view of an exemplary inflater wheel 102. The balloon inflater system 100 may include a balloon inflater frame 126 to which various components may be attached. The balloon inflater frame 126 may be constructed of a rigid material, for example, a metal (e.g., aluminum, steel, galvanized steel, alloy, or titanium), a plastic, a resin, wood, or a composite of multiple materials). While an example of the balloon inflater frame 126 is illustrated herein, in various other examples the balloon inflater frame 126 may have a different shape, different size, additional or fewer components, and/or different dimensions without departing from the scope of the present disclosure.

The inflater wheel 102 may be rotationally attached to the balloon inflater frame 126, for example, at a top end of the balloon inflater frame 126. An inflater wheel bolt 104 may rotationally attach the inflater wheel 102 to the balloon inflater frame 126 to facilitate the inflater wheel 102 rotating about a center axis that is defined by the inflater wheel bolt 104 disposed within a center line of the inflater wheel 102. One or more spacer washers may be disposed between each end of the inflater wheel bolt 104 and the respective sides of the inflater wheel 102 that are aligned with a plane perpendicular to the center axis of the inflater wheel 102.

A ratchet arm 106 may be operably attached on one end to the inflater wheel bolt 104 and aligned in a plane parallel with the planes of the sides of the inflater wheel 102 that are perpendicular to the center axis defined by the inflater wheel bolt 104. The ratchet arm 106 may be operably attached to the inflater wheel bolt 104 to alternately rotate independently of the inflater wheel 102 and in synchrony with the inflater wheel 102 while cooperatively causing the inflater wheel 102 to rotate by a ratcheting operation involving additional components as described herein. These additional components may include a linkage 108 that is operably attached to the ratchet arm 106 on an end opposite of that operably attached to the inflater wheel bolt 104. These additional components may also include a drive wheel 110 to which the linkage 108 is operably coupled at an end opposite of that operably attached to the ratchet arm 106. The drive wheel 110 may be driven to rotate one of clockwise or counterclockwise by a motor 112 and thereby cause the linkage 108 to cause the ratchet arm 106 to perform a ratcheting operation that causes the inflater wheel 102 to rotate about the center axis defined by the inflater wheel bolt 104. Examples described herein show the drive wheel 110 rotating counter-clockwise to cause the inflater wheel 102 to rotate clockwise based on the ratcheting operation involving the ratchet arm 106 and the linkage 108 as described herein.

The motor 112 may be controlled to turn on momentarily by an electronic control system including various electronics as shown in FIG. 2, for example, according to signals received by a remote control receiver 132 from a remote control unit 130, to position a balloon 122 for inflating with air. The balloon 122 may be an example of an air containment vessel. In various embodiments, the balloon 122 may comprise an expandable material or a non-expandable material. In various embodiments, the balloon 122 may comprise rubber, latex, mylar, plastic, foil, polyethylene, or nylon. An air compressor 124 may be configured to selectively output compressed air for inflating the balloon 122 when controlled to do so by the electronic control system, in coordination with the controlled rotation of the inflater wheel 102.

When a countdown timer 134 is activated, the countdown timer 134 may activate a relay that turns on the air compressor 124. The relay may control an electrical connection between a power source 190 and the air compressor 124. The air compressor 124 may then pump compressed air through a tube for inflating the balloon 122 that is positioned for inflation on the inflater wheel 102 by the balloon-positioning belt 120. After the countdown timer 134 counts down to zero, the countdown timer 134 may deactivate the relay to turn off the air compressor 124. The amount of time that the countdown timer 134 counts down between activation and deactivation of the relay may be preset or adjustable by a user or electrical signal from a controller (e.g., the remote control unit 130). In various examples, the amount of time which the countdown timer 134 is configured to count down may include 5 seconds to 10 seconds to 15 seconds to 20 seconds, or other time duration as may be set based on an inflation rate of the balloons 122 by the air compressor 124 to a desired air pressure and/or diameter of the inflated balloon 122. For example, the countdown timer 134 may be configurable to count down from any time ranging from less than 1 second to 99 minutes, in various examples.

Rotation of the inflater wheel 102 may cause a looped balloon-positioning belt 120 that is operably coupled with an outer curved surface of the inflater wheel 102 to rotate through a loop path defined by the inflater wheel 102 and idler pulleys 114, 116, 118. The idler pulleys 114, 116, 118 may keep the balloon-positioning belt 120 under tension using springs, for example, to push the idler pulley 114 upward and/or the idler pulleys 116, 118 downward with sufficient force to apply the intended tension on the balloon-positioning belt 120 to facilitate efficient operation of the balloon inflater system 100. While three idler pulleys 114, 116, 118 are illustrated, in various examples, more or fewer idler pulleys 114, 116, 118 may be deployed along the path of the balloon-positioning belt 120. For example, as the length of the balloon-positioning belt 120 increases, more idler pulleys 114, 116, 118 may be utilized in the balloon inflater system 100. When the inflater wheel 102 positions a given balloon 122 in an appropriate operative position for inflation, the electronic control system may control the air compressor 124 to inflate the given balloon 122.

Outside holes 121 of the balloon-positioning belt 120 may align with alignment pins 136 of the inflater wheel 102 to position the center holes 123 of the balloon-positioning belt 120 in alignment with air passage outlets 144' of the inflater wheel 102. As such, the balloon-positioning belt 120 may be self-aligning with the inflater wheel 102 based on the center holes 123 and the outside holes 121. Mouth openings of the balloons 122 may be inserted within center holes 123 of the balloon-positioning belt 120 to press against an outer curved surface of the inflater wheel 102 while a closed and inflatable end of the balloons 122 are positioned on an opposite side of the balloon-positioning belt 120 to be inflated and rise above the inflater wheel 102 when inflated. When balloons 122 are inserted into the center holes 123 of the balloon-positioning belt 120, the balloon-positioning belt 120 may hold the mouths of the balloons 122 against the inflater wheel 122 such that the openings in the mouths of the balloons 122 are operably coupled with the air passage outlets 144' to receive a flow of compressed air from the air passage outlets 144' (provided by the air compressor 124 through an air hose) to inflate the balloons 122 while the balloons 122 remain inserted in the center holes 123 of the balloon-positioning belt 120 looping through the balloon inflater system 100. Balloons 122 may be inserted within various alternating center holes 123 of the balloon-positioning belt 120. In an example, every center hole 123 of the balloon-positioning belt 120 may have a balloon 122 inserted therethrough. In an example, every other center hole 123 of the balloon-positioning belt 120 may have a balloon 122 inserted therethrough. In an example, every third center hole 123 of the balloon-positioning belt 120 may have a balloon 122 inserted therethrough. In various embodiments, the timing of the electronic control system and the countdown timer 134 may be adjusted, for example, by a controller or the user, to account for the periodicity of balloons 122 present in the balloon-positioning belt.

The inflater wheel 102 may be rotatably held in place on the balloon inflater frame 126 by the inflater wheel bolt 104. The ratchet arm 106 may be coupled with the linkage 108 to cause a proximate end of a ratchet pawl 178 to push ratchet teeth 172 that are attached at uniform distances from each other along a circular path on a side of the inflater wheel 102 facing the ratchet arm 106. The motor 112 may cause the drive wheel 110 to move an end of the linkage 108 distal from the ratchet arm 106 and ratchet pawl 178 along a circular path that in turn causes the ratchet pawl 178 to push one ratchet tooth 172 and the inflater wheel 102 clockwise (in the example shown) for a distance equivalent to a distance between the ratchet teeth 172, then pull back to engage with the next ratchet tooth 172 to prepare to push that next ratchet tooth 172 clockwise for another distance equivalent to a distance between the ratchet teeth 172. (See, for example, FIGS. 8A, 8B, 8C, and 8D.) For each revolution of the drive wheel 110, the inflater wheel 102 may rotate a radial distance equivalent to a radial distance between two neighboring ratchet teeth 172 on the side of the inflater wheel 102. A distal end 174 of the ratchet pawl 178 may have a counterweight 176 attached thereto to cause the proximate end of the ratchet pawl 178 to rise to engage with the ratchet teeth 172 during movement of the ratchet arm 106 and linkage 108. A bolt 175 may couple the linkage 108 and ratchet arm 106 to the ratchet pawl 178 at a pivot point of the ratchet pawl 178.

While the examples illustrated herein show the balloon inflater system 100 configured to cause the inflater wheel 102 to rotate in a clockwise direction as illustrated in FIGS. 1, 8A, 8B, 8C, and 8D, this should not be construed as limiting, as in various other examples, the components of the exemplary balloon inflater system 100 may be configured to instead cause the inflater wheel 102 to rotate in a counterclockwise direction without departing from the teachings, principles of operation, and scope of the disclosure presented herein.

Figure 5:
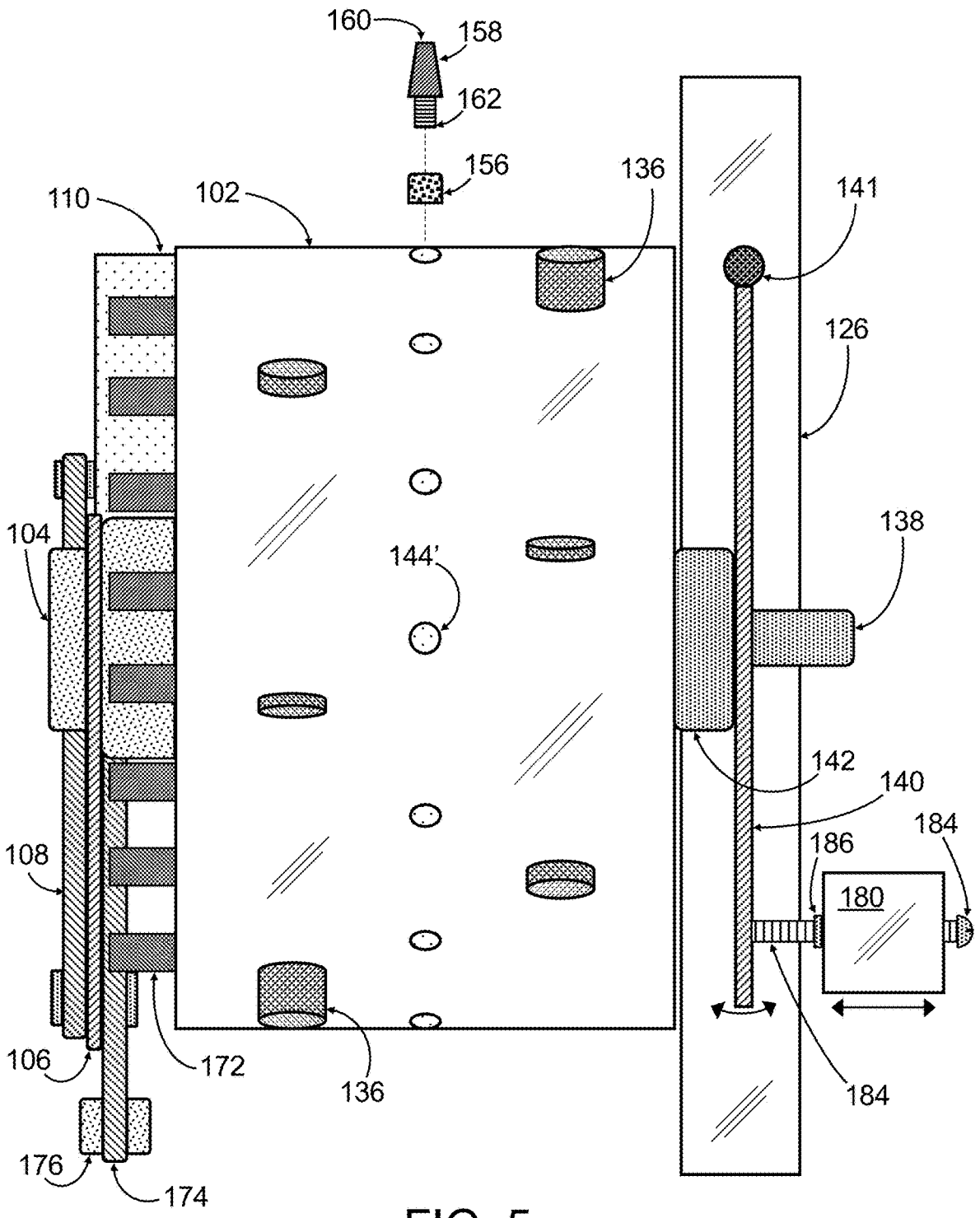
FIG. 5 is a diagram that illustrates a top view of the exemplary balloon inflater system including the inflater wheel.

FIG. 5 is a diagram that illustrates a top view of the exemplary balloon inflater system 100 including the inflater wheel 102. Alignment pins 136 may be inserted into equidistant recesses along either side of the curved surface of the inflater wheel 102 to engage with the outside holes 121 of the balloon-positioning belt 120 to drive the balloon-positioning belt 120 while the inflater wheel 102 rotates. Air passage outlets 144' (and optionally central alignment nubs 156 attached thereto) may be provided equidistant from one another along a central path of the curved surface of the inflater wheel 102. As shown, an air passage may extend from an air passage inlet 144 disposed on a side of the inflater wheel 102 to a corresponding air passage outlet 144' on the curved surface of the inflater wheel 102. Compressed air entering the air passage inlet 144 may exit the corresponding air passage outlet 144' to cause a balloon 122 to inflate when pressed against the curved surface of the inflater wheel 102 above and surrounding the air passage 144' by the balloon-positioning belt 120. When an output portion of an air valve 142 is pressed against the side of the inflater wheel 102 by a pressure plate 140, friction of the output portion of the air valve 142 pressed against the side of the inflater wheel 102 may prevent rotational motion of the inflater wheel 102, for example, by a braking action and/or in the absence of driving motion of the motor 112. In various embodiments, the pressure plate 140 may be formed as an angle bracket with a pressure plate pivot point 141 set by a screw or bolt (or the like) that attaches the pressure plate 140 to the balloon inflater frame at one end of the pressure plate 140. The air valve 142 may be composed of a rubber material or other flexible material that provides friction and air sealing properties when pressed against the side of the inflater wheel 102. When a given air passage inlet 144 is centered within the output portion of an air valve 142 pressed against the side of the inflater wheel 102 by the pressure plate 140, compressed air entering a valve stem 138 (e.g., from the air compressor 124 via an air hose) may pass through the air valve 142 into the given air passage inlet 144, and out the corresponding air passage outlet 144' to inflate a balloon 122 pressed against the curved surface of the inflater wheel 102 above and surrounding the corresponding air passage 144' by the balloon-positioning belt 120. The valve stem 138 and the air valve 142 may be integrated together into a single seamless component, with the air valve 142 disposed on one side of the pressure plate 140 against the inflater wheel 102, and the valve stem 138 dispose on an opposite side of the pressure plate 140 to couple with an air hose from the air compressor 124.

In some examples, an optional balloon inflater insert 158 may be coupled to the air passage outlets 144' and/or central alignment nubs 156 of the balloon inflater wheel 102 via an inflater wheel coupling 162. In such optional examples, the balloon-positioning belt 120 may cause balloons 122 to operably couple with balloon inflater openings 160 of respective balloon inflater inserts 158 to seal the balloons 122 to the balloon inflater openings 160 for inflating the balloons 122 with compressed air input into corresponding air passage inlets 144 on the side of the balloon inflater wheel 102. For example, inflater wheel couplings 162 may operably couple with the air passage outlets 144' to pass compressed air into balloons 122 through the balloon inflater opening 160 of the respective balloon inflater insert 158.

Figure 6:
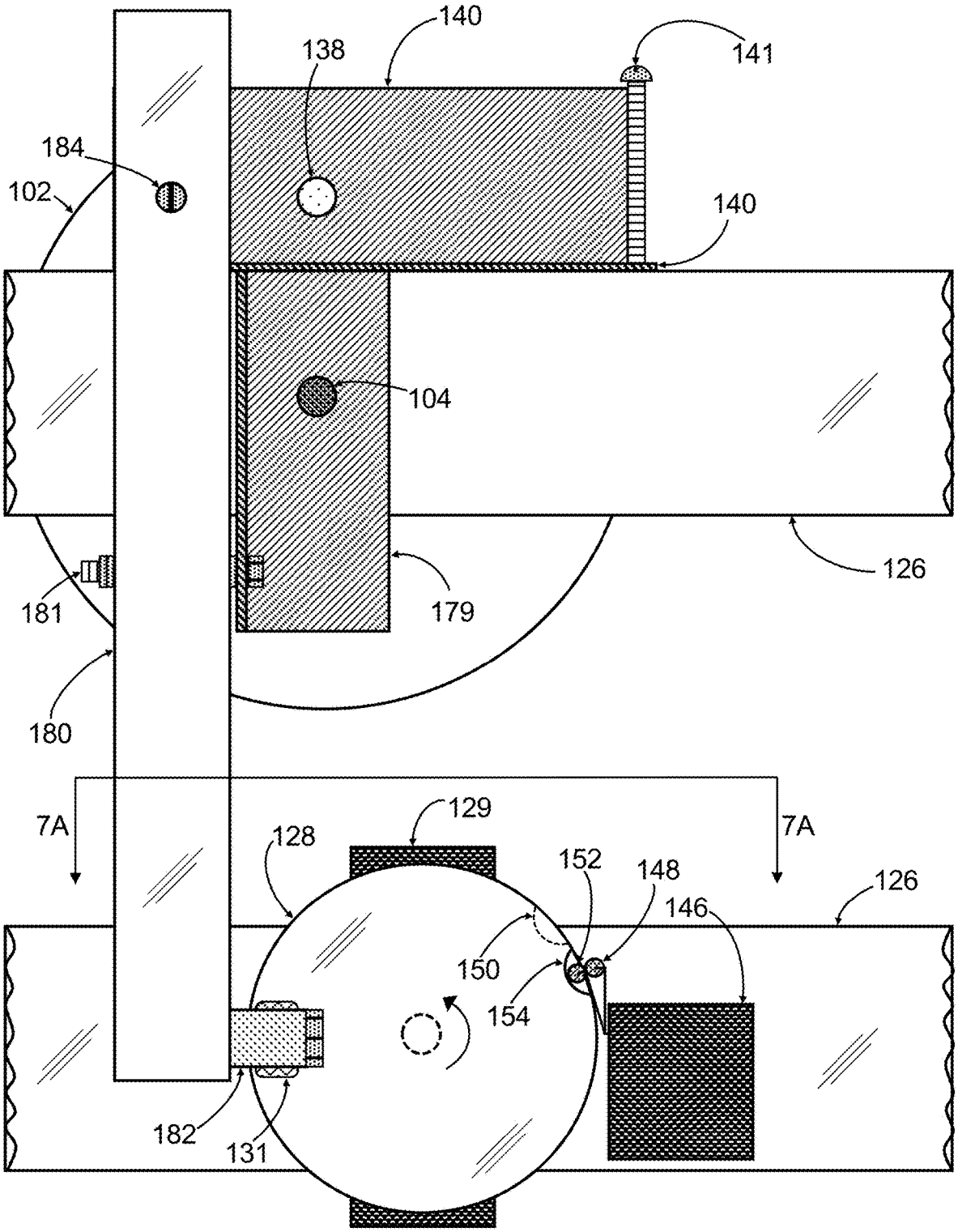
FIG. 6 is a diagram that illustrates a back view of a portion of the exemplary balloon inflater system including the inflater wheel and an exemplary timing wheel.
Figure 7A:
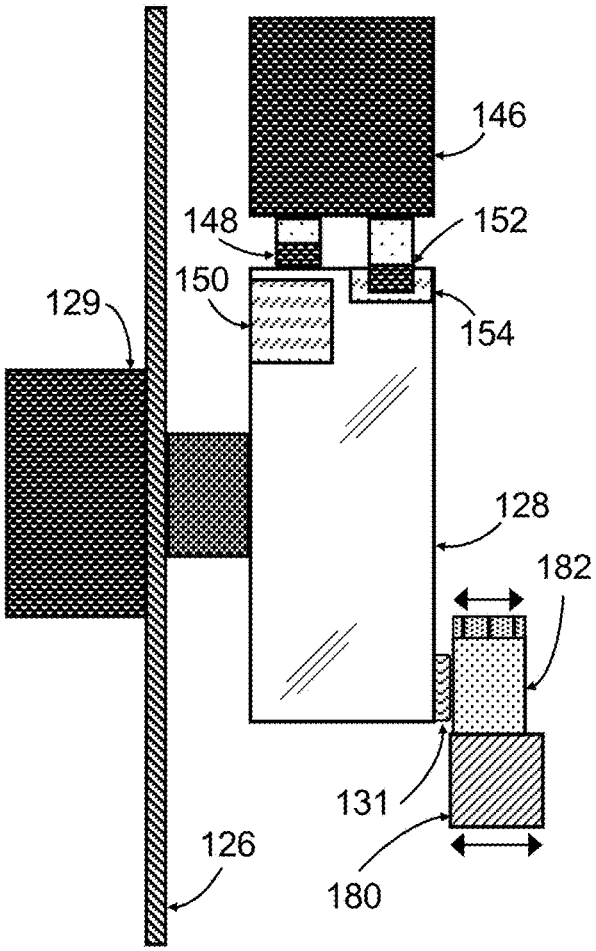
FIG. 7A is a diagram that illustrates a top view of a portion of the exemplary balloon inflater system shown in FIG. 6 including the exemplary timing wheel at a first time.
Figure 7C:
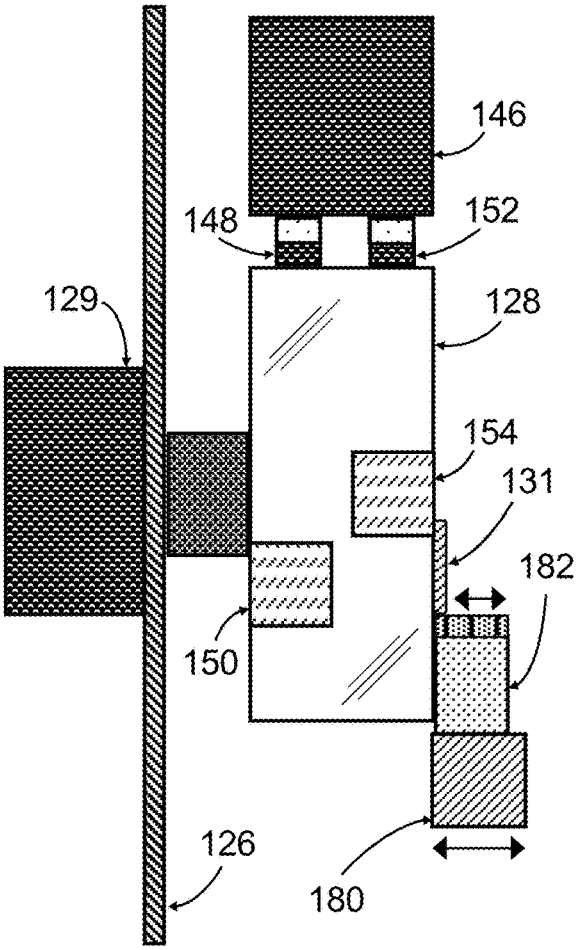
FIG. 7C is a diagram that illustrates a top view of a portion of the exemplary balloon inflater system shown in FIG. 6 including the exemplary timing wheel at a second time.
Figure 7B:
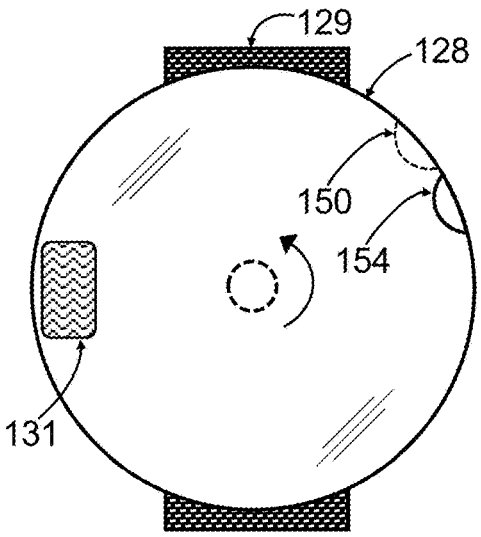
FIG. 7B is a diagram that illustrates the exemplary timing wheel as shown in FIG. 6 at the first time.
Figure 7D:
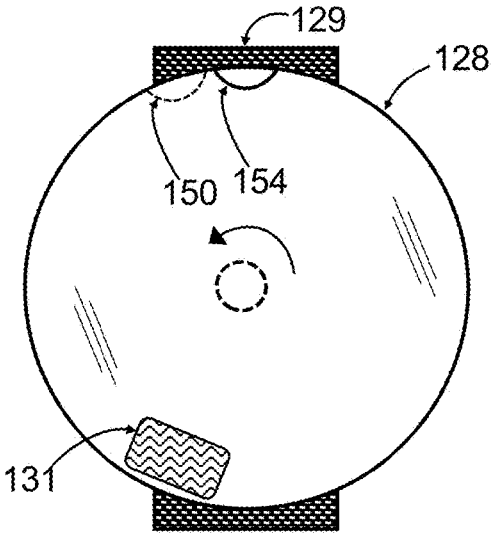
FIG. 7D is a diagram that illustrates the exemplary timing wheel as shown in FIG. 6 at the second time.

FIG. 6 is a diagram that illustrates a back view of a portion of the exemplary balloon inflater system 100 including the inflater wheel 102 and an exemplary timing wheel 128. FIG. 7A is a diagram that illustrates a top view of a portion of the exemplary balloon inflater system 100 shown in FIG. 6 including the exemplary timing wheel 128 at a first time. FIG. 7B is a diagram that illustrates the exemplary timing wheel 128 as shown in FIG. 6 at the first time. FIG. 7C is a diagram that illustrates a top view of a portion of the exemplary balloon inflater system 100 shown in FIG. 6 including the exemplary timing wheel 128 at a second time. FIG. 7D is a diagram that illustrates the exemplary timing wheel 128 as shown in FIG. 6 at the second time.

As shown, two control switches 146 are disposed side by side on one side of the timing wheel 128. The control switches 146 include respective control arms 148, 152 that control changing a switching state of the respective control switch 146 based upon whether the control arms 148, 152 are extended further from the control switch 146 into an indentation bump 150, 154 of the timing wheel 128, or close to the switch by an outer edge of the timing wheel 128. The timing wheel 128 is rotatably coupled with the balloon inflater frame 126 to cause switching operations via the control switches 146. Each of the combinations of one of the control switches 146, a corresponding one of the control arms 148, 152, and a corresponding indentation bump 150, 154 of the timing wheel 128 may perform a different function within the balloon inflater system 100.

For example, inner wheel indentation bump 150 in conjunction with inner control arm 148 and the corresponding one of the pair of control switches 146 may activate the countdown timer 134. When the countdown timer 134 is activated, the countdown timer 134 may activate a relay that turns on the air compressor 124. The relay may control an electrical connection between a power source 190 and the air compressor 124. The air compressor 124 may then pump compressed air through a tube to the valve stem 138 for inflating a balloon 122 that is positioned on the inflater wheel 102 by the balloon-positioning belt 120. After the countdown timer 134 counts down to zero, the countdown timer 134 may deactivate the relay to turn off the air compressor 124. The amount of time that the countdown timer 134 counts down between activation and deactivation of the relay may be preset or adjustable by a user or electrical signal from a controller. In various examples, the amount of time which the countdown timer 134 is configured to count down may include 5 seconds to 10 seconds to 15 seconds to 20 seconds, or other time duration as may be set based on an inflation rate of the balloons 122 by the air compressor 124 to a desired air pressure and/or diameter of the inflated balloon 122. For example, the countdown timer 134 may be configurable to count down from any time ranging from less than 1 second to 99 minutes, in various examples.

A rocker arm 180 may be pivotably coupled to the balloon inflater frame 126, for example, by a bolt and nuts, to pivot about a rocker arm pivot point 181. In an example, the rocker arm 180 may be pivotably coupled to an angle bracket 179 that is in turn fixedly coupled to a horizontally-oriented bracket or beam of the balloon inflater frame 126 to which the inflater wheel 102 is rotatably coupled by the inflater wheel bolt 104. At an upper end of the rocker arm 180, a pressure applicator 184, e.g., a bolt, may be adjustably coupled with the rocker arm 180 to press against the pressure plate 140 when the rocker arm 180 is caused to rock toward the pressure plate 140 above the rocker arm pivot point 181. The pressure applicator 184 may be adjustably fixed to the rocker arm 180 by a pressure applicator position adjuster 186, e.g., a nut, to adjust a distance from and/or a range of motion toward and away from the pressure plate 140 that the pressure applicator 184 travels as well as corresponding amounts of pressure that the pressure applicator 184 applies against the pressure plate 140. The pressure with which the pressure applicator 184 presses against the pressure plate 140 may be adjustable by turning the pressure applicator position adjuster (e.g., nut) 186 to adjust a distance between the end of the pressure applicator 184 touching the pressure plate 140 and the end of the rocker arm 180 to which the pressure applicator 184 is operably attached. At a lower end of the rocker arm 180, a roller wheel 182 may be rotatably coupled with the rocker arm 180 to press and roll against an exterior side of a timing wheel 128 rotatably coupled with the balloon inflater frame 126. The timing wheel 128 may be configured to be driven to rotate by a timing wheel motor 129. A protrusion 131 on an exterior side of the timing wheel 128 may press against the roller wheel 182 attached to the lower end of the rocker arm 180 causing the roller wheel 182 and the lower end of the rocker arm 180 to move horizontally away from a vertical plane of the balloon inflater frame 126, thereby pivoting the rocker arm 180 at the rocker arm pivot point 181 and causing the pressure applicator 184 coupled with the upper end of the rocker arm 180 to press against the pressure plate 140. When the pressure applicator 184 presses against the pressure plate 140, the pressure plate 140 may in turn pivot toward the side of the inflater wheel 102 at the pressure plate pivot point 141 and seal the air valve 142 against a side of the inflater wheel 102, for example, when the air valve 142 is positioned over an air passage inlet 144. The pressure plate pivot point 141 may be set by a bolt or screw that holds one end of the pressure plate 140 onto the balloon inflater frame 126 to facilitate the pivoting at the pressure plate pivot point 141 at which the bolt or screw couples with the pressure plate 140. In this position, a balloon 122 positioned above a corresponding air passage outlet 144' may be effectively inflated by compressed air entering the valve stem 138 and going through the air valve 142 into a corresponding air passage inlet 144.

Timing of the rotation of the inflater wheel 102, rocking of the rocker arm 180, and inflating of the balloon 122 with compressed air may be controlled by the timing wheel 128 and timing wheel motor 129 according to timing elements (e.g., indentation bumps 150, 154 and protrusion 131 as illustrated in the examples described herein) of the timing wheel 128 coupled with control switches 146 having switch control arms 148, 152 configured to control respective switching elements of the control switches 146 according to the relative position of the timing elements (e.g., indentation bumps 150, 154) of the timing wheel 128.

Referring again to FIG. 2, remote control unit 130 may send a remote control signal to the remote control receiver 132 under control of a user. A power source 190 (e.g., a 12V car battery, a marine battery, or other source of electrical power) may be connected via one or more couplers, relays, and/or voltage converters to power the electronic control system, motor 112, timing wheel motor 129, and air compressor 124. In an example, the remote control receiver 132 may receive a control signal from the remote control unit 130 (e.g., operated by a user to control operation of the balloon inflater system 100) and control operations of the electronic control system, accordingly. The remote control unit 130 may include numerous buttons (for example, twelve buttons, sixteen buttons as illustrated herein, or other numbers of buttons, which should not be construed as limiting, as there may be more or fewer buttons in various examples), wherein each of the buttons may be configured to send a control signal to a different remote control receiver 132 installed in a different instance of the balloon inflater system 100. For example, the remote control receiver 132 of one instance of a balloon inflater system 100 may receive a control signal from the remote control unit 130 (e.g., in response to a user pressing a button labeled '1' to correspond to the one instance of the balloon inflater system 100) to initiate operation of the timing wheel motor 129, (e.g., via an electronic switch or controller 170) bypassing the one of the control switches 146 that controls operation of the timing wheel motor 129 (associated with the outer control arm 152 and the outer wheel indentation bump 154, for example). In some examples, the indentation bumps 150, 154 may be protrusions bumping out from the curved surface along the outer circumference of the timing wheel 128, and the control switches 146 may be configured to be activated by protrusions bumping out from the curved surface along the outer circumference of the timing wheel 128. After the timing wheel motor 129 begins rotating, the outer control arm 152 may move out of the outer wheel indentation bump 154 and cause the timing wheel motor 129 to continue to operate as long as the outer control arm 152 is out of the indentation bump 154, even if the remote control unit 130 ceases sending the signal to the remote control receiver 132. Hence, power may be provided to the timing wheel motor 129 to cause the timing wheel motor 129 to rotate until the outer control arm 152 becomes seated in the outer wheel indentation bump 154 again after one rotation of the timing wheel 128. When the outer control arm 152 becomes seated in the outer wheel indentation bump 154 again, the corresponding one of the control switches 146 may disconnect power from the timing wheel motor 129, thereby causing rotation of the timing wheel motor 129 and timing wheel 128 to cease. Thus, the timing wheel motor 129 may cause the timing wheel 128 to rotate for one full revolution in response to a user's single press of the button on the remote control unit 130 that corresponds to the respective balloon inflater system 100.

Also, after the timing wheel motor 129 begins rotating, the motor 112 may be activated to begin rotation of the inflater wheel 102. The inflater wheel 102 may be caused to rotate until rotation of the timing wheel 128 ceases. Near the end of the rotation of the timing wheel 128, after a new balloon 122 is positioned on the inflater wheel 102 to be inflated, the inner control arm 148 may move into and quickly out of the inner wheel indentation bump 150 corresponding to the other of the control switches 146 (that is associated with the inner control arm 148 and the inner wheel indentation bump 150, for example) to cause the respective control switch 146 to activate the countdown timer 134 to control how long the air compressor 124 fills the balloon 122 with air before inflation of the balloon 122 ceases. The countdown timer 134 may be set with an initial time period to operate the air compressor 124, which may be set according to a user setting, according to a firmware programming setting, or according to another manual, programmatic, or automatic setting or process. When the countdown timer 134 reaches zero or a preset turn-off time, the countdown timer 134 may cause the air compressor 124 to cease filling the balloon 122 with air. For example, the countdown timer 134 may be electrically coupled with an electric or electronic relay to cause the relay (e.g., a 30 amp 12 volt relay) to deactivate the air compressor 124 or to cause the air compressor 124 to cease providing compressed air to the valve stem 138 for inflating the balloon 122. For example, the relay may control an electrical connection between the power source 190 and the air compressor 124. The power source 190 may also provide electrical power to the electronic control system and various electronic components thereof.

As illustrated in FIGS. 7A, 7B, 7C, and 7D, the timing wheel 128 may interface with a pair of control switches 146 via a respective pair of control arms 148, 152 matched with corresponding indentation bumps 150, 154 of the timing wheel 128.

As illustrated in FIGS. 7A and 7B, the protrusion 131 on the outside of the timing wheel 128 presses against the roller wheel 182 to press the roller wheel 182 outward from the outside of the timing wheel 128. The roller wheel 182 is coupled with the rocker arm 180 to cause the rocker arm 180 to pivot at the rocker arm pivot point 181 and press the pressure plate 140 toward the inflater wheel 102. When the pressure plate 140 is pressed toward the inflater wheel 102, the air valve 142 may form a seal against the side of the inflater wheel 102 to force pressurized air into an air passage inlet 144 covered by the air valve 142. The pressurized air may then be output from the corresponding air passage outlet 144' into a balloon 122 positioned over the air passage outlet 144' by the balloon-positioning belt 120 to form a seal between the balloon 122 and the curved surface of the inflater wheel 102 around the air passage outlet 144'. The pressure of the pressure plate 140 pressing the air valve 142 against the side of the inflater wheel 102 may also cause friction (e.g., a form of braking action) that prevents unintended rotation of the inflater wheel 102 while the protrusion 131 of the timing wheel 128 presses against the roller wheel 182.

As illustrated in FIGS. 7C and 7D, after the timing wheel motor 129 is activated by the electronic control system (e.g., in response to a switch being flipped or a remote control signal received by the remote control receiver 132), the timing wheel 128 may begin rotating counter-clockwise and out of its resting position as shown so that the outer control arm 152 moves out of its respective outer wheel indentation bump 154, activating its corresponding one of the control switches 146. While the outer control arm 152 is rolling on the outer curved surface of the timing wheel 128 outside of its respective outer wheel indentation bump 154, the corresponding activated one of the control switches 146 may cause the timing wheel motor 129 to continue turning the timing wheel 128 until the outer control arm 152 is again inside its respective outer wheel indentation bump 154 after a full rotation of the timing wheel 128. Also, while the timing wheel 128 is rotating, the protrusion 131 on the outside of the timing wheel 128 may no longer be pressing against the roller wheel 182. The release of the pressure from the protrusion 131 against the roller wheel 182 may facilitate the rocker arm 180 to pivot in an opposite direction at the rocker arm pivot point 181 and release the pressure against the pressure plate 140. This may then release the pressure of the pressure plate 140 and the air valve 142 toward the side of the inflater wheel 102, thereby releasing the braking action of the air valve 142 pressed against the inflater wheel 102. While the braking action is released, the inflater wheel 102 may be sufficiently free of friction from the air valve 142 to facilitate turning. When the pressure against the pressure plate 140 is released, the inflater wheel 102 may be sufficiently movable to rotate the balloon-positioning belt 120 to place another balloon 122 in position to be inflated.

Also, while the timing wheel 128 is rotating with the outer control arm 152 rolling on the outer curved surface of the timing wheel 128 outside of its respective outer wheel indentation bump 154, the corresponding activated one of the control switches 146 may cause the motor 112 to operate and turn the drive wheel 110 to thereby cause the inflater wheel 102 to rotate and move the balloon-positioning belt 120 to position another balloon 122 to be inflated by the air compressor 124 via the air valve 142.

After the timing wheel 128 rotates to a position in which the inner control arm 148 moves into its respective inner wheel indentation bump 150, its corresponding one of the control switches 146 may be activated to initiate a countdown of the countdown timer 134 to begin inflating a balloon 122 that has now been rotated into position to be inflated by rotation of the inflater wheel 102. The balloon 122 that is in position to be inflated may receive compressed air from the air compressor 124 via the air valve 142 while the countdown timer 134 counts down, until the countdown timer 134 reaches a time at which inflation from the air compressor 124 is terminated, for example, by operation of a relay electrically controlled by the countdown timer 134. The inflation of the balloon 122 by the air compressor 124 under control of the countdown timer 134 may begin before rotation of the timing wheel 128 and/or the inflater wheel 102 is completed. The inflation of the balloon 122 by the air compressor 124 under control of the countdown timer 134 may continue after the rotation of the timing wheel 128 and/or the inflater wheel 102 is completed.

As illustrated in FIGS. 7A and 7B, after the timing wheel 128 rotates to a position in which the outer control arm 152 moves into its respective outer wheel indentation bump 154 and the inner control arm 148 moves out of its respective inner wheel indentation bump 150 again, rotation of the timing wheel motor 129 and timing wheel 128 ceases. The countdown of the countdown timer 134 that was initiated by the inner control arm 148 moving into its corresponding inner wheel indentation bump 150 may continue for as long as the countdown timer 134 is set to continue, and the balloon 122 in position to be inflated while the countdown timer 134 continues to count down may continue to be inflated until the countdown timer 134 reaches the conclusion of its countdown and causes inflation by the air compressor 124 to cease, for example, by operation of a relay controlled by the countdown timer 134 to disconnect power from the air compressor 124.

Figure 8A:
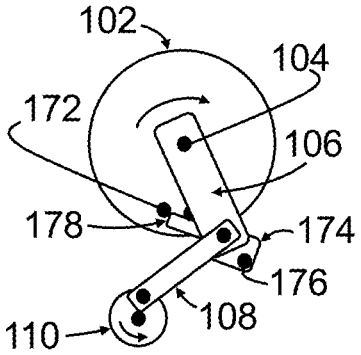
FIGS. 8A, 8B, 8C, and 8D are a series of diagrams that progressively illustrate an exemplary ratcheting operation of the balloon inflater system including the inflater wheel.

FIGS. 8A, 8B, 8C, and 8D are a series of diagrams that progressively illustrate an exemplary ratcheting operation of the balloon inflater system 100 including the inflater wheel 102. As shown in FIG. 8A, the inflater wheel 102 is positioned with a proximal end of the ratchet pawl 178 to the lower right of a first ratchet tooth 172. The ratchet pawl 178 is pivotably attached to a bolt that also attaches the ratchet arm 106 to the linkage 108. A counterweight 176 is attached to the distal end 174 of the ratchet pawl 178 to cause the proximal end of the ratchet pawl 178 to rise to press against the first ratchet tooth 172. A balloon-positioning belt 120 having balloons 122 inserted into center holes therein is configured to go around and be moved by an exterior circular surface of the inflater wheel 102 when the inflater wheel 102 rotates, as shown in FIG. 1. When the motor 112 is activated (e.g., by the application of electrical power to the motor 112), the motor 112 may cause the drive wheel 110 to rotate, thereby causing the linkage 108 attached to the drive wheel 110 to move and thereby cause the ratchet pawl 178 to move.

Figure 8B:
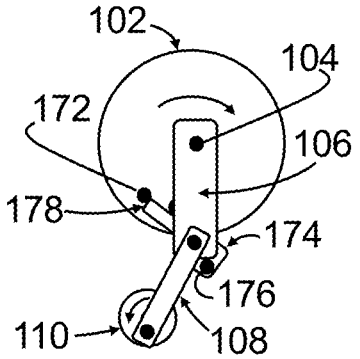
Figure 8C:
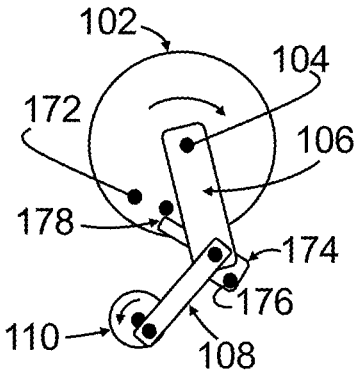
Figure 8D:
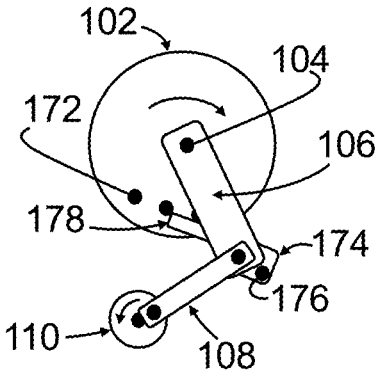

FIG. 8B illustrates that as the drive wheel 110 rotates counterclockwise relative to the position of the drive wheel illustrated in FIG. 8A, the proximal end of the ratchet pawl 178 moves to push the first ratchet tooth 172 leftward to begin causing the inflater wheel 102 to rotate clockwise, and thereby causes the balloon-positioning belt 120 and balloons 122 shown in FIG. 1 to move in concert with the outer curved surface of the inflater wheel 102. FIG. 8C illustrates that as the drive wheel 110 rotates counterclockwise relative to the position of the drive wheel illustrated in FIG. 8B, the proximal end of the ratchet pawl 178 moves to the right of and away from the first ratchet tooth 172 in preparation to engage with a next ratchet pawl 178 that is positioned to the lower right of the first ratchet pawl 178. FIG. 8D illustrates that as the drive wheel 110 rotates counterclockwise relative to the position of the drive wheel illustrated in FIG. 8C, the proximal end of the ratchet pawl 178 moves further to the right of the next ratchet tooth 172 and also upward to place the proximal end of the ratchet pawl 178 from below the next ratchet tooth 172 to the right of the next ratchet tooth 172, in a position similar to that illustrated in FIG. 8A with respect to the first ratchet tooth 172.

In the manner described above with respect to FIGS. 8A-8D, operation of the motor 112 may cause the inflater wheel 102 to rotate and thereby position a new balloon 122 inserted into the balloon-positioning belt 120 above and coupled with an operative air passage outlet 144' to be inflated by the air compressor 124. Various parameters and settings may be configured in construction, adjustment, programmatically, or by a user setting to adjust operation of the balloon inflater system 100. All such configurations and modifications are contemplated by the disclosure herein, and therefore part of the present disclosure. For example, various configurations and modifications may include various values for a diameter of the inflater wheel 102, a diameter of the timing wheel 128, a rotational speed of the motor 112, a rotational speed of the timing wheel motor 129, rotational directions of such wheels and motors, a quantity of the ratchet teeth 172, distances between adjacent air passage inlets 144 and adjacent air passage outlets 144' on the inflater wheel 102, quantity of and distances between adjacent alignment pins 136, pressures applied by the pressure applicator 184 against the pressure plate 140 when the protrusion 131 presses against the roller wheel 182 and when the protrusion 131 does not press against the roller wheel 182, air pressure output from the air compressor 124 when inflating the balloon 122, and various other configurations and modifications that one of ordinary skill in the art may recognize from the disclosure presented herein.

| Index of reference characters: | |
|---|---|
| 100 | Balloon inflater system |
| 102 | Inflater wheel |
| 104 | Inflater wheel bolt |
| 106 | Ratchet arm |
| 108 | Linkage |
| 110 | Drive wheel |
| 112 | Motor |
| 114 | Idler pulley |
| 116 | Idler pulley |
| 118 | Idler pulley |
| 120 | Balloon-positioning belt |
| 121 | Outside hole |
| 122 | Balloon |
| 123 | Center hole |
| 124 | Air compressor |
| 126 | Balloon inflater frame |
| 128 | Timing wheel |
| 129 | Timing wheel motor |
| 130 | Remote control unit |
| 131 | Protrusion |
| 132 | Remote control receiver |
| 134 | Countdown timer |
| 136 | Alignment pin |
| 138 | Valve stem |
| 140 | Pressure plate |
| 141 | Pressure plate pivot point |
| 142 | Air valve |
| 144 | Air passage inlet |
| 144' | Air passage outlet |
| 146 | Control switches |
| 148 | Inner control arm |
| 150 | Inner wheel indentation bump |
| 152 | Outer control arm |
| 154 | Outer wheel indentation bump |
| 156 | Central alignment nub |
| 158 | Balloon inflater insert |
| 160 | Balloon inflater opening |
| 162 | Inflater wheel coupling |
| 170 | Electronic switch or controller |
| 172 | Ratchet tooth |
| 174 | Distal end |
| 175 | Bolt |
| 176 | Counterweight |
| 178 | Ratchet pawl |
| 180 | Rocker arm |
| 181 | Rocker arm pivot point |

-continued

| Index of reference characters: | |
|---|---|
| 182 | Roller wheel |
| 184 | Pressure applicator |
| 186 | Pressure applicator position adjuster |
| 190 | Power source |

In one aspect, a method may be an operation, an instruction, or a function and vice versa. In one aspect, a clause or a claim may be amended to include some or all of the words (e.g., instructions, operations, functions, or components) recited in other one or more clauses, one or more words, one or more sentences, one or more phrases, one or more paragraphs, and/or one or more claims.

To illustrate the interchangeability of hardware and software, items such as the various illustrative blocks, modules, components, methods, operations, instructions, and algorithms have been described generally in terms of their functionality. Whether such functionality is implemented as hardware, software or a combination of hardware and software depends upon the particular application and design constraints imposed on the overall system. Skilled artisans may implement the described functionality in varying ways for each particular application.

The functions, acts or tasks illustrated in the Figures or described may be executed in a digital and/or analog domain and in response to one or more sets of logic or instructions stored in or on non-transitory computer readable medium or media or memory. The functions, acts or tasks are independent of the particular type of instructions set, storage media, processor or processing strategy and may be performed by software, hardware, integrated circuits, firmware, microcode and the like, operating alone or in combination. The memory may comprise a single device or multiple devices that may be disposed on one or more dedicated memory devices or disposed on a computing processor or other similar device. An electronic controller may include electronic circuitry and/or a computing processor configured to perform functions, acts, or tasks described herein. When functions, steps, etc. are said to be "responsive to" or occur "in response to" another function or step, etc., the functions or steps necessarily occur as a result of another function or step, etc. It is not sufficient that a function or act merely follow or occur subsequent to another. The term "substantially" or "about" encompasses a range that is largely (anywhere a range within or a discrete number within a range of ninety-five percent and one-hundred and five percent), but not necessarily wholly, that which is specified. It encompasses all but an insignificant amount.

As used herein, the phrase "at least one of" preceding a series of items, with the terms "and" or "or" to separate any of the items, modifies the list as a whole, rather than each member of the list (e.g., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The word "exemplary" is used herein to mean "serving as an example, instance, or illustration." Any embodiment described herein as "exemplary" is not necessarily to be construed as preferred or advantageous over other embodiments. Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description. No claim element is to be construed under the provisions of 35 U.S.C. § 112, sixth paragraph, unless the element is expressly recited using the phrase "means for" or, in the case of a method claim, the element is recited using the phrase "step for."

While this specification contains many specifics, these should not be construed as limitations on the scope of what may be claimed, but rather as descriptions of particular implementations of the subject matter. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The subject matter of this specification has been described in terms of particular aspects, but other aspects can be implemented and are within the scope of any presented claims. For example, while operations are depicted in the drawings in a particular order, this should not be understood as requiring that such operations be performed in the particular order shown or in sequential order, or that all illustrated operations be performed, to achieve desirable results. The actions recited in any claims may be performed in a different order and still achieve desirable results. As one example, the processes depicted in the accompanying figures do not necessarily require the particular order shown, or sequential order, to achieve desirable results. In certain circumstances, multitasking and parallel processing may be advantageous. Moreover, the separation of various system components in the aspects described above should not be understood as requiring such separation in all aspects, and it should be understood that the described program components and systems can generally be integrated together in a single software product or packaged into multiple software products.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A balloon inflater system comprising:

a rotatable curved inflater wheel having:

alignment pins that radially extend from an outer curved edge of the inflater wheel to rotate synchronously with the inflater wheel, and air passages for passing airflow from a compressed air source through air passage outlets and into balloons positioned at respective ones of the air passage outlets;

a balloon-positioning belt having:

alignment holes that mate with the alignment pins to be driven by the inflater wheel, and balloon centering holes that hold balloons for positioning the balloons over the respective air passage outlets, based on relative positioning of the balloon centering holes and the alignment holes, for inflating the balloons with the airflow from the inflater wheel;

an inflater wheel drive system that causes the inflater wheel to rotate a predetermined angle of rotation to place a next balloon disposed on the balloon-positioning belt in an inflation position; and an airflow control timer that causes airflow from the compressed air source to inflate the balloon disposed on the balloon-positioning belt in the inflation position for a preset period of time.

2. The system of claim 1, wherein the inflater wheel comprises balloon inflater inserts that are positioned at the air passage outlets and configured to pass through the balloon-positioning belt's balloon centering hole and be inserted into the balloon positioned at the balloon centering hole for inflating the balloon.

3. The system of claim 1, wherein the inflater wheel drive system comprises an inflater wheel motor and translates motive power from the inflater wheel motor to rotate the inflater wheel the predetermined angle of rotation to place the next balloon disposed on the balloon-positioning belt in the inflation position, the inflater wheel drive system comprising:

a drive wheel that is driven by the inflater wheel motor to rotate about an axis perpendicular to the plane of the inflater wheel and offset from a center axis of the inflater wheel;

a ratchet arm having a first end configured to rotate about the center axis of the inflater wheel;

a linkage arm having a first end configured to be moved about a circle by the drive wheel and a second end rotatably coupled with a second end of the ratchet arm;

a ratchet pawl rotatably coupled with the second end of the ratchet arm and the second end of the linkage arm, the ratchet pawl weighted at a distal end to cause a proximal end of the ratchet pawl engage with ratchet teeth evenly disposed about a circular path on a side of the inflater wheel to which the ratchet arm is disposed;

wherein a single rotation of the drive wheel causes the inflater wheel to rotate an angle corresponding to the angular distance between neighboring ratchet teeth.

4. The system of claim 3, wherein a single rotation of the drive wheel causes the inflater wheel to rotate the predetermined angle of rotation to place the next balloon disposed on the balloon-positioning belt in the inflation position.

5. The system of claim 1, further comprising a plurality of idler pulleys configured to guide the balloon-positioning belt along a circular path driven by the inflater wheel, while the balloon-positioning belt holds balloons disposed within the balloon-centering holes, wherein the balloon-positioning belt is constructed as a closed loop.

6. The system of claim 1, wherein the inflater wheel comprises:

a plurality of air passage inlets corresponding to the plurality of air passage outlets, each air passage inlet operably coupled with a respective air passage outlet through a respective air passage through an interior of the inflater wheel, the air passage inlets disposed on a side of the inflater wheel opposite the inflater wheel drive system and evenly disposed about a circular path proximate the outer curved edge of the inflater wheel;

an air valve coupled with a valve stem that receives airflow from the compressed air source; and a pressure plate that presses the air valve against a side of the inflater wheel to seal the air valve around a corresponding air passage inlet when inflating a respective balloon positioned over the respective air passage outlet, and releases pressure of the air valve against the side of the inflater wheel when the inflater wheel rotates to place the next balloon disposed on the balloon-positioning belt in the inflation position.

7. The system of claim 6, wherein the pressure plate is pivotally fixed to a frame to which the inflater wheel is rotatably attached on one end, and is alternately pressed toward the inflater wheel and released away from the inflater wheel by a pressure applicator position adjuster on an opposite end of the pressure plate.

8. The system of claim 7, further comprising:

a timing wheel, a timing wheel motor configured to rotate the timing wheel responsive to a signal to place the next balloon disposed on the balloon-positioning belt in the inflation position;

a rocker arm configured to pivot about a rocker arm pivot point, the rocker arm having the pressure applicator position adjuster on one end and a roller wheel on the other end, the rocker arm pivot point disposed between the pressure applicator position adjuster and the roller wheel; and a protrusion disposed on a side of the timing wheel and configured to rest under the roller wheel when a balloon is disposed in the inflation position while pressing outward against the roller wheel to cause the rocker arm to pivot about the rocker arm pivot point to cause the pressure applicator position adjuster to press the pressure applicator and the air valve against the side of the inflator wheel with the respective air passage inlet.

9. The system of claim 8, wherein the timing wheel comprises a first wheel indentation bump on one side of the timing wheel and a second wheel indentation bump on an opposite side of the timing wheel, the second wheel indentation bump proximate and temporally behind the first wheel indentation bump relative to a rotational direction of the timing wheel, the system further comprising:

a first control arm and switch operative to initiate inflation of the balloon disposed on the balloon-positioning belt in the inflation position when engaging with the first wheel indentation bump; and a second control arm and switch operative to cause the timing wheel motor to rotate the timing wheel when the second control arm is not engaging with the second wheel indentation bump until the second control arm again engages with the second wheel indentation bump after one rotation of the timing wheel.

10. The system of claim 9, wherein the inflater wheel may be rotated by the inflater wheel drive system responsive to rotation of the timing wheel, and the first control arm and switch initiates inflation of the balloon disposed on the balloon-positioning belt in the inflation position by engaging with the first wheel indentation bump near the end of a rotation of the timing wheel.

11. A method of operating a balloon inflater system for inflating a series of balloons, the method comprising:

positioning a balloon-positioning belt to travel along a curved outside edge of a rotatable curved inflater wheel, the curved inflater wheel having:

alignment pins that radially extend from an outer curved edge of the inflater wheel to rotate synchronously with the inflater wheel, and air passages for passing airflow from a compressed air source through air passage outlets and into balloons positioned at respective ones of the air passage outlets; and the balloon-positioning belt having:

alignment holes that mate with the alignment pins to be driven by the inflater wheel, and balloon centering holes that hold balloons for positioning the balloons over the respective air passage outlets, based on relative positioning of the balloon centering holes and the alignment holes, for inflating the balloons with the airflow from the inflater wheel;

placing a next balloon disposed on the balloon-positioning belt in an inflation position by causing the inflater wheel to rotate a predetermined angle of rotation by an inflater wheel drive system; and causing airflow from the compressed air source to inflate the balloon disposed on the balloon-positioning belt in the inflation position for a preset period of time by an airflow control timer.

12. The method of claim 11, further comprising positioning balloon inflater inserts at the air passage outlets of the inflater wheel to pass through the balloon-positioning belt's balloon centering hole and be inserted into the balloon positioned at the balloon centering hold for inflating the balloon.

13. The method of claim 11, further comprising:

rotating the inflater wheel the predetermined angle of rotation to place the next balloon disposed on the balloon-positioning belt in the inflation position by translating motive power from an inflater wheel motor comprised by the inflater wheel drive system;

driving a drive wheel by the inflater wheel motor to rotate about an axis perpendicular to the plane of the inflater wheel and offset from a center axis of the inflater wheel;

rotating a first end of a ratchet arm about the center axis of the inflater wheel;

moving a first end of a linkage arm coupled with the drive wheel about a circle of the drive wheel while a second end of the linkage arm is rotatably coupled with and moves a second end of the ratchet arm;

causing a proximal end of a ratchet pawl to engage with ratchet teeth evenly disposed about a circular path on a side of the inflater wheel to which the ratchet arm is disposed, the ratchet pawl rotatably coupled with the second end of the ratchet arm and the second end of the linkage arm, the ratchet pawl weighted at a distal end;

wherein a single rotation of the drive wheel causes the inflater wheel to rotate an angle corresponding to the angular distance between neighboring ratchet teeth.

14. The method of claim 13, further comprising rotating the inflater wheel the predetermined angle of rotation in a single rotation of the drive wheel to place the next balloon disposed on the balloon-positioning belt in the inflation position.

15. The method of claim 11, further comprising guiding, by a plurality of idler pulleys, the balloon-positioning belt along a circular path driven by the inflater wheel, while the balloon-positioning belt holds balloons disposed within the balloon-centering holes, wherein the balloon-positioning belt is constructed as a closed loop.

16. The method of claim 11, further comprising:

receiving airflow from the compressed air source at a valve stem coupled with an air valve;

pressing the air valve against a side of the inflater wheel, by a pressure plate, to seal the air valve around a corresponding air passage inlet that corresponds to a respective air passage outlet, the air passage inlet operably coupled with the respective air passage outlet through a respective air passage through an interior of the inflater wheel, the air passage inlets disposed on a side of the inflater wheel opposite the inflater wheel drive system and evenly disposed about a circular path proximate the outer curved edge of the inflater wheel; and releasing pressure of the air valve against the side of the inflater wheel when the inflater wheel rotates to place the next balloon disposed on the balloon-positioning belt in the inflation position.

17. The method of claim 16, further comprising alternately pressing the pressure plate toward the inflater wheel and releasing the pressure plate away from the inflater wheel by a pressure applicator position adjuster on one end of the pressure plate, while pivoting the pressure plate about a pivot point at which the pressure plate is fixed to a frame to which the inflater wheel is rotatably attached on an opposite end of the pressure plate.

18. The method of claim 17, further comprising:

rotating a timing wheel by a timing wheel motor responsive to a signal to place the next balloon disposed on the balloon-positioning belt in the inflation position;

pivoting a rocker arm about a rocker arm pivot point, the rocker arm having the pressure applicator position adjuster on one end and a roller wheel on the other end, the rocker arm pivot point disposed between the pressure applicator position adjuster and the roller wheel; and positioning a protrusion disposed on a side of the timing wheel under the roller wheel when a balloon is disposed in the inflation position while pressing outward against the roller wheel to cause the rocker arm to pivot about the rocker arm pivot point; and causing the pressure applicator position adjuster to press the pressure applicator and the air valve against the side of the inflater wheel with the respective air passage inlet, by the pivoting of the rocker arm about the rocker arm pivot point.

19. The method of claim 18, wherein the timing wheel comprises a first wheel indentation bump on one side of the timing wheel and a second wheel indentation bump on an opposite side of the timing wheel, the second wheel indentation bump proximate and temporally behind the first wheel indentation bump relative to a rotational direction of the timing wheel, the method further comprising:

initiating inflation of the balloon disposed on the balloon-positioning belt in the inflation position, by a first control arm and switch when engaging with the first wheel indentation bump; and causing the timing wheel motor to rotate the timing wheel, by a second control arm and switch when the second control arm is not engaging with the second wheel indentation bump until the second control arm again engages with the second wheel indentation bump after one rotation of the timing wheel.

20. The method of claim 19, further comprising:

rotating the inflater wheel by the inflater wheel drive system responsive to rotation of the timing wheel; and initiating inflation of the balloon disposed on the balloon-positioning belt in the inflation position by the first control arm and switch engaging with the first wheel indentation bump near the end of a rotation of the timing wheel.

* * * * *